US006354405B1

(12) United States Patent
Svensson-Hilford et al.

(10) Patent No.: US 6,354,405 B1
(45) Date of Patent: Mar. 12, 2002

(54) ELEVATOR SYSTEM

(75) Inventors: Lennart Svensson-Hilford; René Matthe, both of Berlin (DE)

(73) Assignee: Inventio AG, Hergiswil (DE)

( * ) Notice: Subject to any disclaimer, the term of this patent is extended or adjusted under 35 U.S.C. 154(b) by 0 days.

(21) Appl. No.: 09/622,993

(22) PCT Filed: Feb. 19, 1999

(86) PCT No.: PCT/CH99/00080

§ 371 Date: Oct. 5, 2000

§ 102(e) Date: Oct. 5, 2000

(87) PCT Pub. No.: WO99/43586

PCT Pub. Date: Sep. 2, 1999

(30) Foreign Application Priority Data

Feb. 25, 1998 (EP) ..... 98810153

(51) Int. Cl.[7] ..... B66B 1/20

(52) U.S. Cl. ..... 187/384; 187/391; 187/414

(58) Field of Search ..... 127/380, 381, 127/382, 388, 384, 391, 393, 414

(56) References Cited

U.S. PATENT DOCUMENTS

| | | | | |
|---|---|---|---|---|
| 4,979,594 A | * | 12/1990 | Begle et al. | 187/121 |
| 5,538,357 A | * | 7/1996 | Boswell, Sr. | 187/211 |
| 5,689,094 A | * | 11/1997 | Friedli et al. | 187/384 |
| 6,011,839 A | * | 1/2000 | Friedli et al. | 187/384 |
| 6,125,971 A | * | 10/2000 | Niebuhr et al. | 187/231 |
| 6,223,160 B1 | * | 4/2001 | Kostka et al. | 187/380 |

FOREIGN PATENT DOCUMENTS

| | | | |
|---|---|---|---|
| DE | 39 11 667 A1 | | 10/1990 |
| EP | 727 382 A2 | | 8/1996 |
| FR | 1 600 333 | | 8/1970 |
| JP | 5-161867 | * | 5/1993 |

OTHER PUBLICATIONS

Article entitled "Ein Fahrschein–System für Los Angeles" by Adrian Reusser published in SIGNAL1—DRAHT, (1993) Nov. No. 11, 4 pp.

* cited by examiner

*Primary Examiner*—Jonathan Salata
(74) *Attorney, Agent, or Firm*—Cohen, Pontani, Lieberman & Pavane

(57) ABSTRACT

An elevator installation having a system of making payments so that the installation can be operated as a means of transport for providing chargeable transportation services for persons and/or goods. Also provided is an identification device for recognition of types of cashless payment, a calculation device for cashless calculation of transportation services to, for example, trip destinations input within a time window, and a charging device for cashless debiting of the costs of transportation services. The identification device can recognize different types of cashless payment such as tokens, tokens with electronic chips, prepayment cards, cards or keys with data carriers, or transmitter/receiver systems or biometric systems with individual data of the user. The charging for transportation services can, for example, take place in relation to operations-specific and/or user-specific criteria.

11 Claims, 5 Drawing Sheets

ELEVATOR SYSTEM

BACKGROUND OF THE INVENTION

1. Field of the Invention

The invention relates to an elevator installation with means for entering the destination floor and for making payment so that the installation can be operated as a means of transport for providing chargeable transportation services for persons and/or goods.

2. Discussion of the Prior Art

French patent specification FR 1 600 333 an elevator installation is known with which a specified price has to be paid in cash for a specified distance of travel. The number of floors corresponding to the value of the inserted coins is noted by an electromechanical device. During the trip, a bolt which represents one floor is reset after each floor that is traveled past. When all the floor bolts have been reset, the elevator is stopped at the floor. The payments received are used to pay off the investment costs of the installation, and to cover the maintenance and running costs.

A disadvantage of the known device is that the coin receptacle containing the travel payments is frequently the object of criminal activities. A forcibly opened and plundered coin operation of the elevator installation, are the consequences. A further disadvantage is that the user must always have a corresponding number of coins ready, the number of coins inserted being directly related to the number of floors to be traveled.

SUMMARY OF THE INVENTION

Accordingly, it is an object of the present invention to provide an elevator installation which overcomes the problems of the prior art while at the same time providing a theft proof elevator for chargeable trips.

Pursuant to this object, and others which will become apparent hereafter, one aspect of the present invention resides in an elevator installation having means for entering a destination floor, means for making cashless payment, means for identifing the type of cashless payment, calculation means for calculating costs of the transportation services, and means for debiting the costs.

Another aspect of the invention resides in a method for operating an elevator installation on a fee-per use basis, comprising the steps of entering a destination floor, in an input unit, presenting a type of cashless payment, identifying the cashless payment, calculating transportation services which are input within a time window, and charging for the transportation services by cashless debiting of costs of these services.

The main advantages of the invention are that cashless payment for the individual transportation costs does not give rise to additional costs for operating and maintaining the coin-collection equipment, and the operator of the elevator does not suffer loss or inconvenience due to theft. The electronic means of payment can be used not only to pay the price of the trip; with them the elevator system can also at the same time record individual data of the particular user, and carry out specific user wishes. Additionally, the charges made can be adapted to the specific situation, such as free travel on special occasions, higher prices during peak traffic, bonuses for frequent travelers, special prices for solo trips, etc. The means of cashless payment also offer the advantages of individual charging for a specified time period, and central recording and charging of the transportation services provided, not only by one elevator installation but by several elevator installations together, with the result that the administrative costs of charging can be kept low for each individual elevator. Furthermore, the elevator according to the invention has the advantage that additional services provided during the trip can be individually charged.

BRIEF DESCRIPTION OF THE DRAWINGS

The invention is described in more detail below by reference to drawings illustrating an exemplary embodiment. The drawings show.

DETAILED DESCRIPTION OF THE PREFERRED EMBODIMENTS

Figure 1:
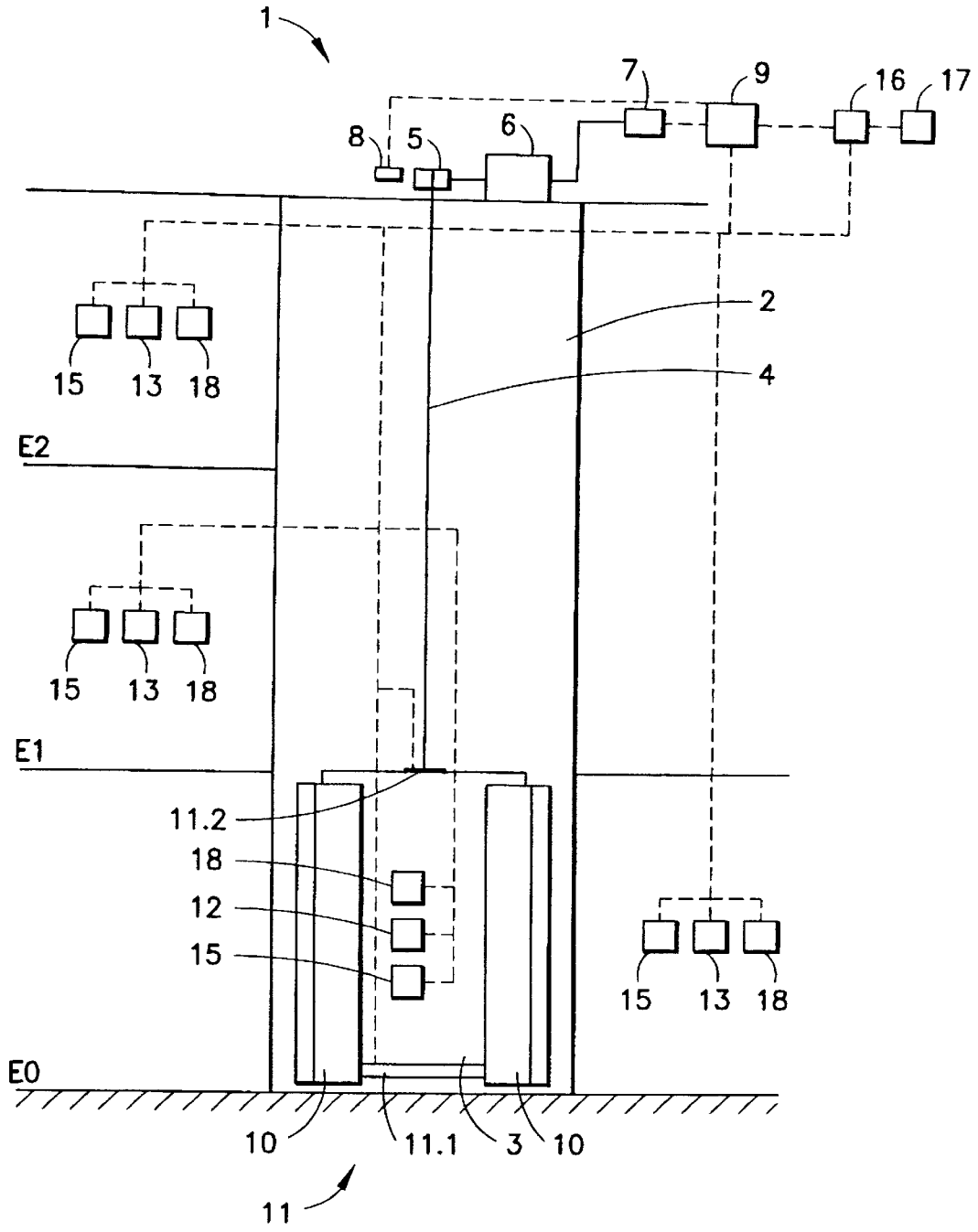
FIG. 1 is a diagrammatic representation of a conventional elevator installation with a car operating panel for use as a chargeable means of vertical transportation.
Figure 2:
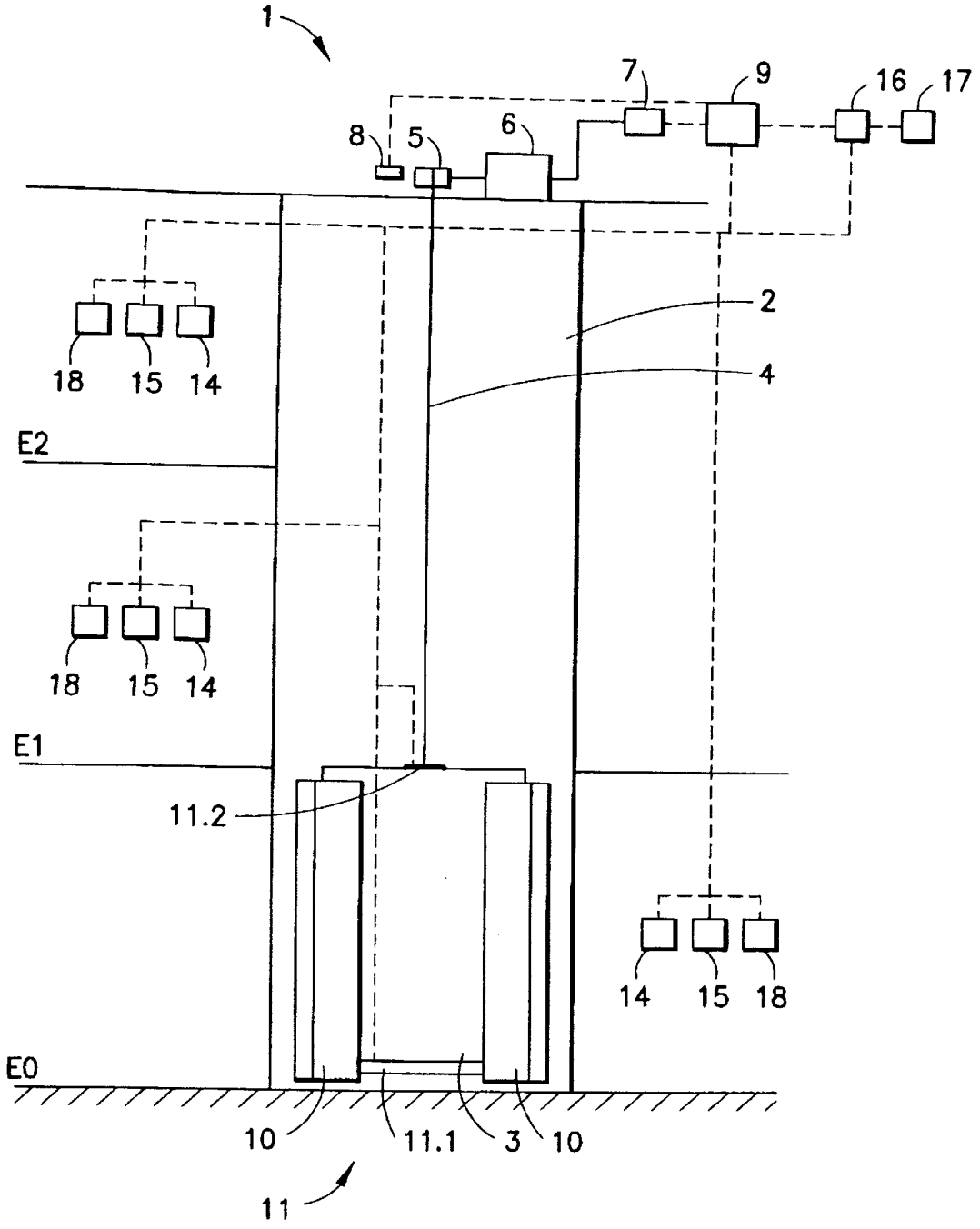
FIG. 2 is a diagrammatic representation of an elevator installation with destination call control for use as a chargeable means of vertical transportation.

In FIGS. 1 and 2, 1 represents an elevator installation which has an elevator car 3 capable of traveling in a hoistway 2. The elevator car 3 is suspended on ropes 4 which pass over a traction sheave 5. A counterweight (not shown) serves to counterbalance the weight of the elevator car 3. The traction sheave 5 is set into motion by a drive machine 6 which is supplied with energy by an electrical drive 7. To monitor the movement of the traction sheave 5, and thereby the position of the elevator car 3, a sensor 8 is provided whose signal is transmitted to an elevator control 9 which issues travel commands to the electrical drive 7. The elevator car 3 can be closed by means of car doors 10 which operate hoistway doors (not shown) running parallel to them. To measure the weight of persons and/or goods in the car 3, a load measuring device 11 is provided consisting of, for example, a load-weighing floor 11.1 or a weighing system 11.2 located on the car carrying frame. In the elevator car 3 shown in FIG. 1 there is a car operating panel 12 by means of which the travel destinations are communicated to the elevator control 9. On the floors E0, E1 and E2 landing control stations 13, which are connected to the elevator control 9, are provided for the purpose of calling the elevator car 3. In FIG. 2 the elevator car 3 has no car operating panel. On each of the floors E0, E1 and E2 there is a means of entering the destination floor 14 consisting, for example, of a ten-digit keypad with display. By means of the ten-digit keypad, travel destinations are communicated to the elevator control 9 from the floors E0, El, E2 and not from the elevator car 3. In the case of a group of elevators, the display of the ten-digit terminal indicates to the user which elevator will serve the required floor. The signal transmission lines are shown as dashed lines.

In the exemplary embodiment shown in FIGS. 1 and 2 the elevator installation 1 has a main floor E0 and two further floors E1, E2. It is also possible for there to be only one, or more than two, further floors. On each floor E0, E1, E2, and also in the elevator car as shown in FIG. 1, an identification device 15, which may take the form of, for example, a read/write device, is provided for the purpose of identifying user data and/or means of payment. Each identification device is connected to a calculation device 16 which calculates the transportation services used. The calculation device 16 is also connected to a charging device 17 for the purpose of charging for the transportation services used. Also on each floor E0, E1, E2 there is a display device 18 which communicates to the user information from the elevator control 9 relating, for example, to the momentary position of the elevator car 3, or by means of which, if the display device 18 has a touch screen, the user can communicate his/her opinion of the elevator system based on a questionnaire, for example. In return, no-charge trips can be offered to the user. The display device 18 can also be combined with the landing control station 13, or with the destination input device 14, and/or with the identification device 15.

FIGS. 1 and 2 show an elevator installation 1 having a rope traction elevator. Instead of the rope traction elevator, the elevator installation 1 can comprise a ropeless elevator, an elevator with no suspension rope, or a hydraulically driven elevator, on which the trip distance can be measured by measuring the distance traveled or the movement of the hydraulic jack.

The identification device 15 can recognize different means of payment such as tokens, tokens with electronic chips, prepayment cards, keys with data carriers with individual data relating to the user, and cards or other data carriers with individual data relating to the user. Depending on the card type, the identification device 15 can communicate with the card either with or without contact. Instead of the card with individual data relating to the user or to the goods to be transported, it is also possible to use a remotely operating transmitter/receiver system with individual data relating to the user or the goods.

Tokens are valued by the identification device 15 according to their value and/or number and the value is passed on to the calculation device 16. The calculation device 16 opens a time window of, for example, a few seconds and waits for the travel destination to be input. If no travel destination is input, when the time window closes a command is sent to the identification device 15 to eject the token. In the case of infrequently used installations, the time window can be in the range of minutes or hours. If a trip destination is input, the calculation device 16 calculates the transportation costs for the transportation services as requested via the car operating panel 12 or destination input device 14 and, provided that the value of the tokens is sufficient for the transportation services requested, transmits authorization of the transportation services to the elevator control 9. If the value of the tokens is insufficient, the user is requested by means of the display device 18 to make additional payment and/or is transported only as far as the floor corresponding to the value of the tokens paid.

With prepayment cards, or tokens with electronic chips, charging for and authorizing the transportation services is carried out in a manner similar to that with tokens. The identification device 15 determines the value of the card, and transmits the value to the calculation device 16. This calculates the transportation costs for the transportation services as requested via the car operating panel 12 or destination input device 14 within the time window and, provided that the value of the prepayment card is sufficient for the transportation services requested, transmits authorization of the transportation service to the elevator control 9. The calculation device 16 simultaneously communicates the transportation costs to the identification device 15, which reduces the value of the card by the amount of the transportation costs. If the value of the card is insufficient, the user is informed of this by means of the display device 18 and authorization of the transportation service to the elevator control 9 is prevented.

If the user uses a card with individual data, or a transmitter/receiver system, the identification device 15 reads in, or receives, the data and transmits it to the calculation device 16 which evaluates the data in relation, for example, to the requested floor, individual transportation conditions, solo trips, special trips, no-charge trips, charging to third parties, method of charging, information provided by the user, access code, etc. and checks for authorization to use a transportation service. The calculation device 16 opens a time window of, for example, a few seconds and waits for the trip destination to be input. The time window can also be defined by the length of time for which the card is inserted, or by operation of the transmitter/receiver system. If no trip destination is input, when the time window closes a request to re-insert or remove the card is sent to the identification device 15. If a trip destination is input, the calculation device 16 calculates the transportation costs for the requested transportation service and transmits authorization of the transportation service to the elevator control 9. The calculation device 16 simultaneously transmits the transportation costs to the charging device 17, which deducts the transportation costs from the account of the relevant user.

Further possible means of checking the user's authorization are the input of an access code by the user via the trip destination input device 14, or the use of biometrics systems to register the user's fingerprint or iris, for example, and transmission of this information to the identification device 15. The calculation, authorization, and charging then take place in the same way as for the card with individual data for the transmitter/receiver system.

A time window of 5 to 10 seconds, for example, is necessary so that the particular transportation service can be matched unambiguously to the relevant user and then assigned to the relevant account. As a general rule, the calculation device 36 processes one trip destination per time window. In special applications the calculation device can be programmed in such a way that it can process at least one trip destination per time window.

The calculation device 16, and/or the charging device 17, can also serve as a central unit for charging and debiting the transportation costs for several elevator installations. Calculation of the transportation costs can take place in relation to, for example, the trip duration, trip direction, the individual number of trips made by a particular user, the trip distance and/or the weight to be transported, combinations of these, or other freely-selectable or user-related criteria. The trip distance can be calculated either as the number of floors given by the difference between the starting floor and the destination floor, or by measuring the distance traveled by means of, for example, the sensor 8 which monitors the position of the elevator car 3, or some other means of measuring the distance. Measurement of the weight of persons and/or goods is performed by the load measuring device 11 in the form of, for example, a load-weighing floor 11.1 or a weighing system 11.2 located on the car carrying frame of the elevator car 3, or weighing scales (not shown) located in front of the elevator. The elevator control 9 transmits the data concerning the trip distance and/or weight to the calculation device 16.

Figure 3:
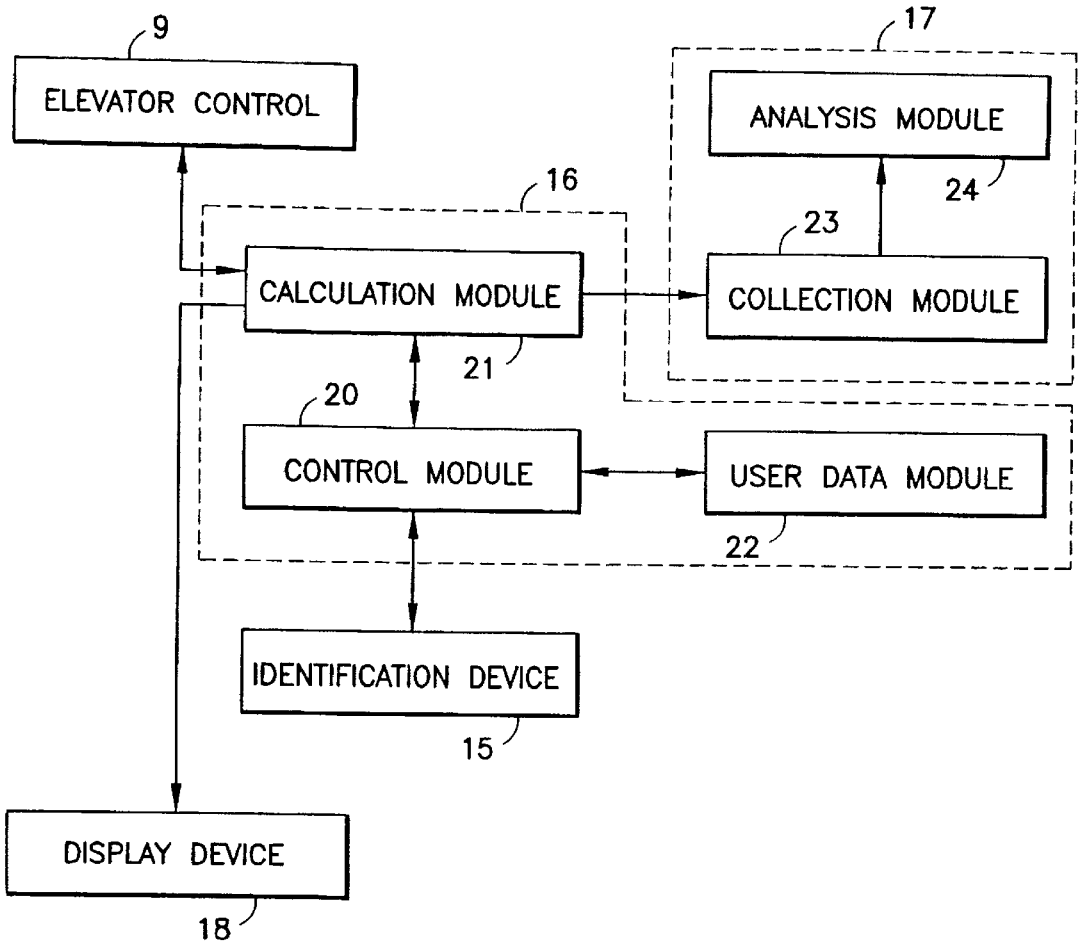
FIG. 3 is a diagrammatic representation of a device for calculating and charging for the transportation services provided by the elevator installation.

FIG. 3 shows details of the calculation device 16 and the charging device 17. The identification device 15 recognizes the means of cashless payment and passes on the corresponding data to a control module 20 of the calculation device 16. If the data record is recognized as one from a prepayment card or a token, the value of the prepayment card or token is passed on to a calculation module 21. The elevator control 9 communicates the trip destination of the user to the calculation module 21, which calculates the transportation costs and compares them with the value of the card or token. If the card or token has sufficient value, the calculation module 21 transmits authorization of the transport service to the elevator control system 9 and causes the corresponding amount to be deducted from the prepayment card or token. If the value of the card or token is insufficient, the display device 18 indicates this to the user and the transportation service provided is limited to the value of the card or token at the most.

If a data record from either a card or key with a data carrier is recognized, or a transmitter/receiver system, or a biometric system with individual data, or an access code of the person and/or goods to be transported is recognized, then the control module 20 looks up the corresponding user data in a user data module 22 and passes this on to the calculation module 21 for calculation of the transportation costs. The transportation costs, trip data, and user data are then passed on to a collection module 23. Periodically, for example at month-end, an analysis module 24 analyses the collection module 23, which is organized as a database, and produces an invoice for each user, or deducts the transportation costs from a corresponding user account and produces for each user a statement of account showing the transportation costs and trip data.

Calculation of the transportation costs can take into account operations-related criteria such as peak traffic, time of day, traffic intensity on the installation, direction of travel, etc., and/or user-related criteria such as solo trips, trip distance, weight, no-charge trips, etc. The relevant data is provided to the calculation module 21 by the elevator control 9 and/or the identification device 15 and/or the user data module 22.

The user data can also contain trip destinations and special transportation requirements of the user. This makes it possible to reserve for the user a standard destination floor which depends on the floor at which the user enters the elevator. The user can accept the pre-specified standard destination and will be transported to this destination without taking any further action. If the user wishes to travel to a destination other than the pre-defined standard destination, the user can change the destination via the landing control station 13 or the destination input device 14.

Figure 4:
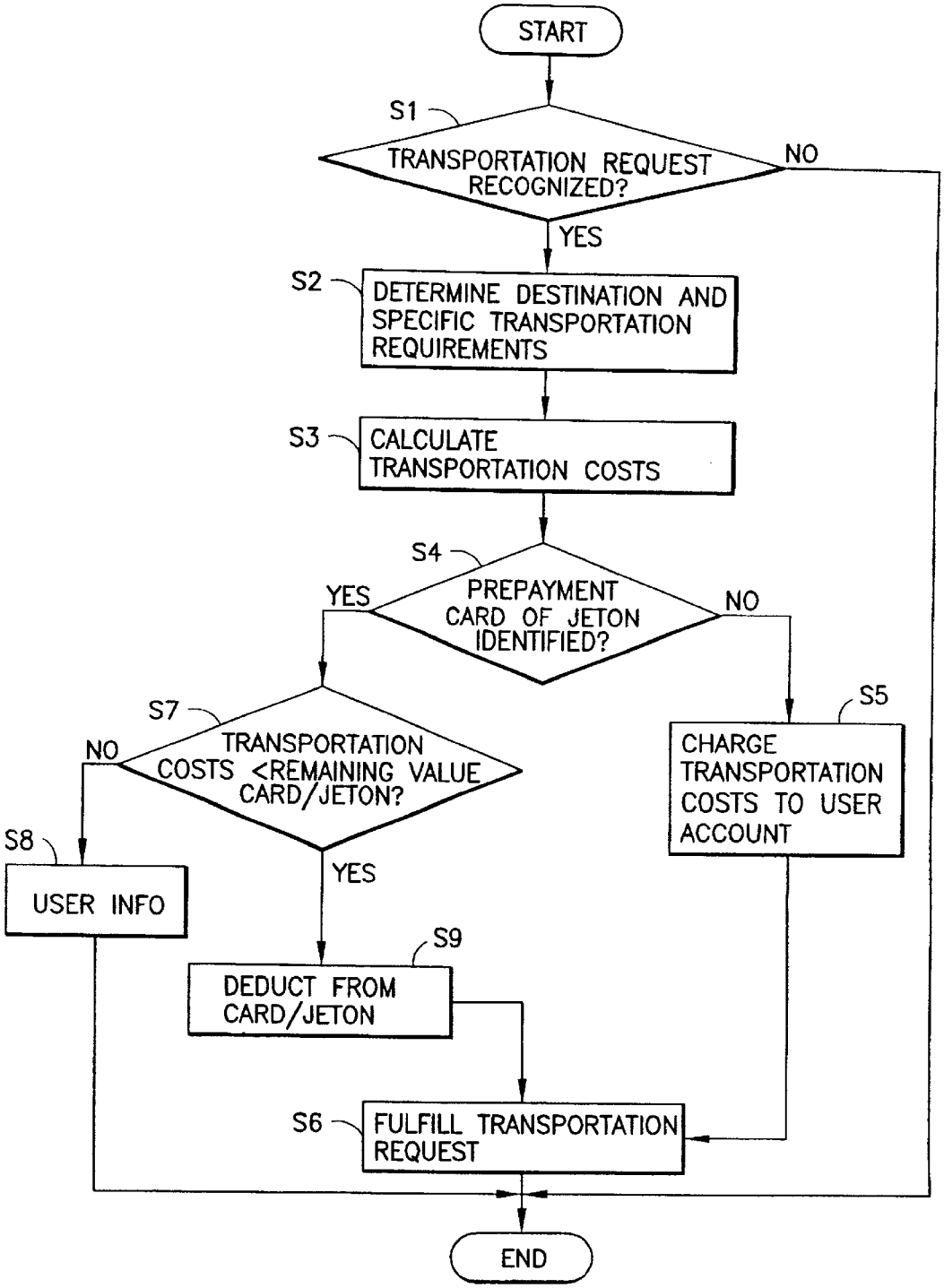
FIG. 4 is a flowchart representing the process of identifying, calculating, and charging for chargeable transportation services.

FIG. 4 shows a flowchart to illustrate the identification, calculation, and charging procedure for chargeable transportation services. In step S1 a check is made as to whether a transportation service is required. If the result of the check is negative, as indicated with N, the procedure is terminated. If the result of the test is positive, as indicated with Y, the trip destination and the operations-specific and/or user-specific criteria are determined in step S2. In step S3 this data is used to calculate the transportation costs. In step S4 a check is made as to whether the transportation costs will be paid for by means of tokens, tokens with electronic chips, or prepayment cards. If the result of the check is negative, as indicated with N, (i.e. the transportation will be paid for with a card or key with a data carrier, or a transmitter/receiver system, or a biometric system with individual data of the person and/or goods to be transported), in step S5 the transportation costs are individually deducted, or recorded and periodically charged at a later date. Following this, in step S6, the transportation service is performed. If the check in step S4 has a positive result, as indicated with Y, step S7 checks whether the calculated transportation costs are covered by the tokens, tokens with electronic chips, or prepayment card. If the result of the test in step S7 is negative, as indicated with N, step S8 is executed, in which the user is informed that the value of the means of cashless payment is too small, and at the most a transportation service is performed which corresponds to the value available. If the result of the test in step S7 is positive, as indicated with Y, in step S9 the costs of the transportation services are debited from the token with electronic chip or the prepayment card and the transportation services are then performed in step S6.

Figure 5:
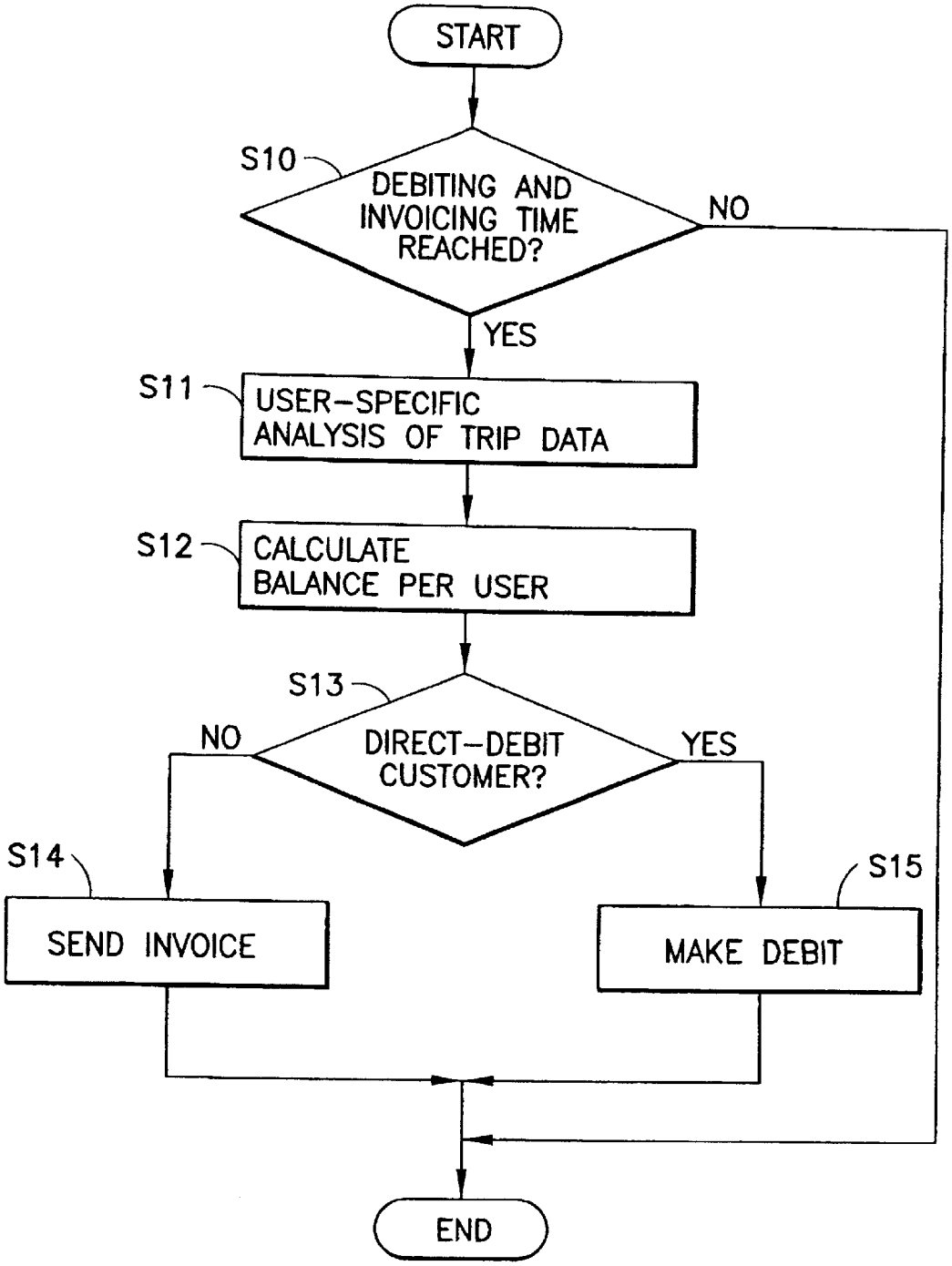
FIG. 5 is a flowchart representing a periodic charging process.

FIG. 5 shows a flowchart to illustrate a periodic invoicing and direct debiting procedure for transportation services which have been performed. In step 10 a check is made as to whether the time for invoicing and direct debiting, for example the end of the month, has arrived. If the result of the test in step S10 is negative, as indicated with N, the procedure is terminated. If the result of the test is positive, as indicated with Y, step S11 analyzes the stored trip data and the costs of the transportation services provided to each user and in step S12 a balance is calculated for each user. Step S13 checks whether the respective user is one for whom the charges can be debited directly. If the result of the test in step S13 is negative, as indicated with N, in step S14 an invoice is produced for and sent to the respective user. If the result of the test in step S13 is positive, as indicated with Y, in step S15 the accumulated transportation costs of the respective user are debited from the account of the respective user.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An elevator installation, comprising:

means for entering a destination floor;

means for making cashless payment so that the installation is operable as a fee-per-use installation;

identification means for recognizing the cashless payment means;

calculation means for calculating transportation services which are input within a time window; and charging means for cashless debiting of costs of the transportation services.

2. An elevator installation according go claim 1, wherein the calculation means includes means for calculating the costs of transportation services in relation to selectable criteria.

3. An elevator installation according to claim 2, wherein the means for calculating the costs of transportation services calculates the costs in relation to operations-specific criteria.

4. An elevator installation according to claim 2, wherein the means for calculating the costs of the transportation services calculates the costs in relation to user-specific criteria.

5. An elevator installation according to claim 3, wherein the means for calculating the costs of the transportation services calculates the costs at least one of in relation to a distance traveled as defined by the trip destination and in relation to weight of persons and goods as determined by means of load measurement.

6. An elevator installation according to claim 4, wherein the means for calculating the costs of the transportation services calculates the costs at least one of in relation to a distance traveled as defined by the trip destination and in relation to weight of persons and goods as determined by means of load measurement.

7. An elevator installation according to claim 1, wherein the means of cashless payment include one of: tokens, tokens with electronic chips, prepayment cards, cards or keys with data carriers, transmitter/receiver systems, and biometric systems with individual data relating to the at least one of persons and goods.

8. An elevator installation according to claim 1, wherein the calculating means includes a calculation module for calculating the costs of the transportation services in relation to at least one of operations-specific and user-specific criteria, the calculation means further including a user data module containing individual data of users, and a control module operative to transmit data from the identification means and the user module to the calculation module.

9. An elevator installation according to claim 8, wherein the identification device is a read/write device operative to recognize, and deduct payment from, one of tokens and prepayment cards.

10. A method of cashless operation of an elevator installation as a fee-per-use installation, comprising the steps of:

entering a destination floor in an input unit;

presenting cashless payment means;

recognizing the cashless payment means;

calculating transportation services which are input within a time window; and charging the cashless payment means by debiting costs of the transportation services.

11. A method for operating an elevator installation as a fee-per-use installation, comprising the steps of:

determining whether a transportation service is required, if yes, determining destination and specific transportation requirements; calculating transportation costs based upon the determined destination and transportation requirements; checking whether the transportation costs will be paid by one of tokens, tokens with electronic chips and prepayment cards, if no, one of individually deducting and recording and periodically charging the costs at a later date and performing the transportation services, if yes, checking whether the calculated transportation costs are covered by the one of tokens, tokens with electronic chips and payment cards;

informing a user that the value of the payment means is insufficient if the calculated transportation costs are not covered by the tokens, tokens with electronic chips and payment cards;

deducting, if the transportation costs are determined to be covered by the tokens, from the tokens and prepayment cards; and performing the transportation services.

* * * * *